US010651529B2

(12) United States Patent
Obermayer et al.

(10) Patent No.: US 10,651,529 B2
(45) Date of Patent: May 12, 2020

(54) THREADLESS TUNING ELEMENTS FOR COAXIAL RESONATORS, AND METHOD FOR TUNING SAME

(71) Applicant: KATHREIN-WERKE KG, Rosenheim (DE)

(72) Inventors: Maximilian Obermayer, Rosenheim (DE); Franz Rottmoser, Schechen (DE); Michael Spunt, München (DE)

(73) Assignee: Kathrein-Werke KG, Rosenheim (DE)

( * ) Notice: Subject to any disclaimer, the term of this patent is extended or adjusted under 35 U.S.C. 154(b) by 56 days.

(21) Appl. No.: 15/742,743

(22) PCT Filed: Jul. 8, 2016

(86) PCT No.: PCT/EP2016/066364
§ 371 (c)(1),
(2) Date: Jan. 8, 2018

(87) PCT Pub. No.: WO2017/005926
PCT Pub. Date: Jan. 12, 2017

(65) Prior Publication Data

US 2018/0212298 A1 Jul. 26, 2018

(30) Foreign Application Priority Data

Jul. 9, 2015 (DE) ..... 10 2015 008 894

(51) Int. Cl.
*H01P 7/04* (2006.01)
*H01P 1/202* (2006.01)
(Continued)

(52) U.S. Cl.
CPC ..... *H01P 7/04* (2013.01); *H01P 1/202* (2013.01); *H01P 1/2133* (2013.01); *H01P 7/10* (2013.01)

(58) Field of Classification Search
CPC ..... H01P 7/04; H01P 1/202; H01P 1/2133; H01P 7/10
(Continued)

(56) References Cited

U.S. PATENT DOCUMENTS 4,460,878 A 7/1984 Fouillet et al.
2011/0102110 A1 5/2011 Taskila et al.
(Continued)

FOREIGN PATENT DOCUMENTS

CN 200986958 Y 12/2007
DE 10 61 848 7/1959
(Continued)

OTHER PUBLICATIONS

International Preliminary Report on Patentability and Written Opinion of the International Searching Authority dated Jan. 18, 2018, issued in corresponding International Application No. PCT/EP2016/066364 and English translation.
(Continued)

*Primary Examiner* — Benny T Lee
*Assistant Examiner* — Hafizur Rahman
(74) *Attorney, Agent, or Firm* — Nixon & Vanderhye, P.C.

(57) ABSTRACT

A high-frequency filter with a coaxial design has at least one resonator with a first inner conductor and an outer conductor housing. The outer conductor housing comprises a housing base, a housing cover which is arranged at a distance from the housing base, and a peripheral housing wall between the housing base and the housing cover. The first inner conductor is galvanically connected to the housing base and extends axially from the housing base in the direction of the housing cover. The resonator comprises a second internal conductor which is galvanically connected to the housing cover and extends axially from the housing cover in the direction of the
(Continued)

housing base. The first and/or second inner conductor has an inner conductor bore, and a tuning element is arranged in one inner conductor bore in a thread-free axially movable manner. The tuning element is arranged in a sleeve or bushing and optionally or in addition thereto has an enlarged elastic region.

17 Claims, 13 Drawing Sheets

(51) Int. Cl.
*H01P 1/213* (2006.01)
*H01P 7/10* (2006.01)

(58) Field of Classification Search
USPC ..... 333/224
See application file for complete search history.

(56) References Cited

U.S. PATENT DOCUMENTS

| | | | | |
|---|---|---|---|---|
| 2011/0115575 | A1 | 5/2011 | Wong | |
| 2013/0009728 | A1* | 1/2013 | Puoskari | H01P 1/2053 333/203 |
| 2015/0035623 | A1* | 2/2015 | Kwak | H01P 1/2053 333/203 |

FOREIGN PATENT DOCUMENTS

| | | | | |
|---|---|---|---|---|
| DE | 26 20 769 | | 11/1977 | |
| DE | 10 2010 056 048 | | 6/2012 | |
| SU | SU552654 A | * | 4/1977 | H01P 1/20 |
| WO | WO 2014/063829 | | 5/2014 | |

OTHER PUBLICATIONS

International Search Report and Written Opinion of the ISA for PCT/EP2016/066364, dated Oct. 7, 2016, 16 pages.

* cited by examiner

THREADLESS TUNING ELEMENTS FOR COAXIAL RESONATORS, AND METHOD FOR TUNING SAME

CROSS-REFERENCE TO RELATED APPLICATIONS

This application is the U.S. national phase entry of International Application No. PCT/EP2016/066364 filed Jul. 8, 2016; which claims priority to German Patent Application No. 10 2015 008 894.7 filed. Jul. 9, 2015. The disclosures of these applications are incorporated herein in their entirety by reference.

STATEMENT REGARDING FEDERALLY SPONSORED RESEARCH OR DEVELOPMENT

None.

FIELD

The invention relates to a high frequency filter in coaxial construction that can be tuned by at least one tuning element, the tuning element being movable, in a threadless manner, inside the high frequency filter.

BACKGROUND AND SUMMARY

In radio systems, in particular in the mobile radio sector, a common antenna is frequently used for transmitted and received signals. In this context, the transmitted and received signals each use different frequency ranges, and the antenna has to be suitable for transmitting and receiving in the two frequency ranges. Therefore, to separate the transmitted and received signals, a suitable frequency filtering is required, by means of which, on the one hand, the transmitted signals are passed from the transmitter to the antenna and, on the other hand, the received signals are passed from the antenna to the receiver. In order to separate the transmitted and received signals or to combine or separate mobile radio bands, nowadays inter alia high frequency filters in coaxial construction are used. In this case, two interconnected high frequency filters form what is known as a duplex separating filter, which allows transmitters and receivers to be interconnected in a largely decoupled manner on a common antenna. For example, a pair of high frequency filters can be used, which both allow a certain frequency band to pass (bandpass filters). As an alternative, a pair of high frequency filters can be used, which both block a certain frequency band (band-stop filters). Furthermore, a pair of high frequency filters can be used, of which one filter allows frequencies below a frequency between the transmitting and receiving band to pass and blocks frequencies above this frequency (low-pass filters), and the other filter blocks frequencies below a frequency between the transmitting and receiving band and allows frequencies above this to pass (high-pass filters). Further combinations of the aforementioned filter types are also conceivable. This also applies for high frequency filters that are formed as single filters, i.e. have just one input and one output.

High frequency filters that consist of coaxial resonators can be easily produced from milled or cast parts. Furthermore, these resonators ensure a high electrical quality and relatively high thermal stability.

However, in order to be able to achieve optimal filtering results, fine-tuning is required after production.

WO 2014/063829 A1 discloses a high frequency filter in which tuning elements can be inserted into the resonator. Inserting said tuning elements causes a change in the resonance frequency of the high frequency filter. The tuning elements are screwed in from outside the high frequency filter. This occurs via a threaded connection between the tuning element and a bush that is inserted into an opening of the high frequency filter. WO 2014/063829 A1 is disadvantageous in that introducing a bush of this kind together with the necessary thread is complex and in that automated tuning can be achieved only with difficulty.

DE 26 20 769 A1 discloses a tunable high frequency filter. An internal conductor is galvanically connected to a front face of the high frequency housing and extends from this front face towards an opposing further front face of the high frequency housing. A pin is arranged on this further front face and extends towards the internal conductor. The internal conductor comprises an internal conductor bore, into which the pin protrudes.

The internal conductor is formed in two parts, the second part being longitudinally movable in a telescopic manner in the first part, meaning that the internal conductor is formed in multiple parts and is adjustable in length. The distance by which the second part of the internal conductor can be moved relative to the first part of the internal conductor can be set by a threaded rod that is rigidly connected to the second part of the internal conductor and can be actuated from the outside of the high frequency filter.

DE 10 2010 056 048 A1 discloses a further high frequency filter. Said filter comprises an internal conductor that is galvanically connected to a housing base of the high frequency filter and extends from the housing base towards the housing cover. At the same time, a first tuning element extends from the housing base towards the housing cover. The internal conductor comprises an internal conductor bore, into which the first tuning element extends. A second tuning element can be screwed or pushed into the internal conductor bore from outside the high frequency filter, by means of a thread.

A disadvantage of DE 10 2010 056 048 A1 is that abrasion can result when using a thread, which abrasion leads to intermodulation products. In the event that the second tuning element is merely pushed in, the diameter of the internal conductor bore and the outside diameter of the tuning element must be very precisely matched to one another in order to ensure permanent retention.

The object of the present invention is therefore that of providing a high frequency filter and a method for tuning the high frequency filter, which filter and method are more cost-effective and simpler to produce and carry out, respectively, and provide better results over a longer period of time compared with the prior art.

The high frequency filter in coaxial construction according to the invention comprises at least one resonator comprising a first internal conductor and comprising an external conductor housing. The external conductor housing comprises a housing base, a housing cover that is spaced apart from the housing base, and a peripheral housing wall between the housing base and the housing cover. A first internal conductor is galvanically connected to the housing base and extends in the axial direction from the housing base towards the housing cover. The first internal conductor ends at a distance from the housing cover and/or is galvanically isolated from the housing cover. The resonator further comprises a second internal conductor that is galvanically connected to the housing cover and extends in the axial direction from the housing cover towards the housing base.

The first and the second internal conductors are axially immovable, i.e. are not adjustable in length, and are mutually coaxial. The first internal conductor and the housing base, just like the second internal conductor and the housing cover, are preferably formed integrally. The first and/or second internal conductor comprise an internal conductor bore. The internal conductor bore of the first or second internal conductor penetrates the external conductor housing and leads into an insertion opening.

A tuning element is arranged inside the internal conductor bore of the first or second internal conductor, so as to be axially movable. In this case, the tuning element is designed and/or arranged such that a portion of the tuning element enters the free clearance between the two internal conductors to varying extents. Furthermore, a bush or a sleeve is arranged in a form-locked or force-locked manner inside the internal conductor bore, between the first internal conductor and the tuning element or the second internal conductor and the tuning element. Alternatively or additionally thereto, the tuning element comprises a region having a widened diameter, this region being located either in the centre of the tuning element and/or at the end of the tuning element that is closer to the insertion opening. The region having the widened diameter is elastically deformable, at least in the radial direction, towards the longitudinal axis that extends centrally through the tuning element.

It is particularly advantageous for the tuning element to be axially movable, meaning that no thread is required. Since the tuning element can be moved axially in the internal conductor bore in a threadless manner, smaller filters can be produced because the diameter of the internal conductor bore is no longer restricted to a minimum diameter that was previously necessary in order to still be able to accommodate a thread. Omitting the thread also results in less metal abrasion during tuning, which abrasion would cause interfering effects in the high frequency filter (PIM—passive intermodulation). The tuning element can be pressed into the internal conductor bore, for example, preferably injected therein by means of compressed air. It is further advantageous for there to be a further second internal conductor in addition to a first internal conductor, the two internal conductors extending coaxially towards one another. Improved filter effects can be achieved as a result, it being possible for the high frequency filter to be tuned particularly easily by means of the tuning element being inserted into the resonator to varying extents. Using a bush or a sleeve means that the internal conductor bore does not need to be additionally specially further processed in order to ensure that the tuning element is fitted optimally or exactly. Furthermore, the internal conductor bore can be produced having a consistent diameter. Subsequently, the diameter of the tuning element can then be selected as desired, by selecting the appropriate bush or sleeve. Since the tuning element comprises a resilient region having a widened diameter, it is possible to ensure, without using a thread, that the tuning element is fitted securely and permanently inside the internal conductor bore.

Threadless movement is also not known in this context. Although U.S. Pat. No. 4,460,878 discloses threadless movement of different components, this does not relate to a tuning element but instead to an extension of the internal conductor. Said document does not disclose the use of a plurality of internal conductors and the immovable attachment thereof to a housing cover and to a housing base, or the fact that the internal conductor bore of the first or second internal conductor opens into an insertion opening on the external conductor housing and is thus directly accessible from the outside. Moreover, the use of a bush or sleeve is not disclosed. It is also not disclosed that the tuning element is intended to comprise a widened region that is resilient.

The method according to the invention for tuning the high frequency filter, as has been described for example according to independent claim 1, comprises various method steps. In a first method step, the high frequency filter is sealed. In the further method step, a connection is produced between an attachment device arranged on the tuning element and a coupling means of the adjusting device. In a following method step, the tuning element is inserted into the internal conductor bore of the first or second internal conductor. These steps can be carried out in any desired sequence. The filter properties are subsequently measured, the tuning element being pushed further towards the insertion opening or away from the insertion opening, using the coupling means of the adjusting device, depending on the measurement result. Subsequently, the method steps of "measuring" and "moving" are repeated until the high frequency filter has the desired filter properties. When this state has been reached, an adhesive connection is added between the tuning element and the internal conductor bore of the first or second internal conductor, as a result of which connection the tuning element is fixed, in a permanent and immovable manner, in the axial position thereof inside the internal conductor bore.

A particular advantage in this case is the axial movement of the tuning element inside the internal conductor bore, which movement can be achieved in a particularly simple manner using the coupling means, which is a component of the adjusting device, by means of a linear motor or stepper motor.

In addition, widening a region of the tuning element means that said region having the widened diameter is oversized relative to the internal conductor bore, and the remaining region is undersized relative to the internal conductor bore. As a result of the region having the widened diameter, the region without the widened diameter is also arranged centrally inside the internal conductor bore. In this case, the tuning element rests inside the internal conductor bore in a force-locked manner, but can nonetheless be moved by means of a stepper motor or a linear motor. The tuning element no longer moves autonomously, and therefore said element can, for example, very easily be permanently fixed, by means of an adhesive connection, to the internal conductor bore, i.e. to the inside wall of the internal conductor bore.

In order to facilitate the elastic deformability, the region having the increased diameter can be slotted at least in part. As a result, the tuning element can be inserted more easily into the internal conductor bore, it nonetheless being ensured, at the same time, that the tuning element rests inside the internal conductor bore in a force-locked manner and that the position of said element does not change on account of gravity alone, or as a result of shocks during the process for producing and/or tuning the high frequency filter.

The tuning element is arranged in the internal conductor bore of the first internal conductor and protrudes therefrom into the internal conductor bore of the second internal conductor, the front faces of the two internal conductors preferably not touching, and further preferably being arranged so as not to have any mutual overlap, such that neither of the internal conductors enters the other internal conductor in each case. It would also be possible for the tuning element to be arranged in the internal conductor bore of the second internal conductor and to protrude therefrom into the internal conductor bore of the first internal conductor. Here, too, the two internal conductors should not touch and can in addition be arranged so as not to have any mutual overlap. Overlapping would, however, also be possible. In another embodiment, the internal conductor bore of the first internal conductor has a larger diameter, overall, than the second internal conductor, the second internal conductor then entering the internal conductor bore of the first internal conductor at least in part. A clearance is formed between the two internal conductors, which in this case overlap at least in part radially towards the outside, i.e. the internal conductors do not touch. In this case, the tuning element is designed and/or arranged such that at least a portion of the tuning element enters the free clearance between the two internal conductors to varying extents. In this case, the tuning element can be mushroom-shaped for example. The same applies for the case in which the internal conductor bore of the second internal conductor has a larger diameter than the first internal conductor, and said first internal conductor enters the internal conductor bore of the second internal conductor.

In a further embodiment, it may also be possible for the end of the tuning element furthest from the insertion opening to comprise a receiving opening. In this case, the second internal conductor can enter the receiving opening of the tuning element when the tuning element is arranged in the internal conductor bore of the first internal conductor. The same applies when the tuning element is arranged in the internal conductor bore of the second internal conductor, the first internal conductor entering said second internal conductor in this case.

The corresponding embodiments regarding the arrangement of the tuning element relative to the first and/or second internal conductor, and the arrangement of the two internal conductors relative to one another, are dependent on the frequency range over which the high frequency filter must be tuned.

The internal conductor bore preferably widens towards the insertion opening, i.e. towards the outside of the external conductor housing. This widening can be tapered or conical in longitudinal section, for example. A parabolic widening is also possible. Not only is the insertion of the tuning element facilitated as a result, but said widening can also make it easier to receive adhesives, by means of which the tuning element can be fixed in the internal conductor bore in a permanent and rigid manner.

It is also possible for the tuning element to comprise a first sliding surface as a peripheral surface, which surface extends at least in the region in which the tuning element is guided inside the internal conductor bore. A second sliding surface is preferably located in the internal conductor bore as an inside wall, it being necessary for the coefficients of friction of the first and the second sliding surfaces to be selected such that the tuning element is arranged securely inside the internal conductor bore and can be moved axially after insertion only by using a stepper motor or a linear motor.

The bush or sleeve is preferably resilient, and preferably further consists of a dielectric material. The bush is used to produce a force-locked connection to the tuning element. The bush can consist of a rubber compound for example. The bush is arranged in a form-locked or force-locked manner inside the internal conductor bore of the first or second internal conductor. Instead of a bush, as mentioned, a sleeve can also be used, the sleeve being pulled over the tuning element before the tuning element is inserted into the internal conductor bore. In contrast, a bush is already located inside the internal conductor bore before the tuning element is inserted. Both the bush and the sleeve, which preferably both consist of a dielectric material, furthermore allow the tuning element to also be formed of an electrically conductive material instead of a dielectric material, of which said element is preferably formed.

When a bush is used, the ends thereof preferably comprise an at least partially peripheral flange, so that the bush is arranged in an axially immovable manner inside the internal conductor bore of the first or second internal conductor. The at least partially peripheral flange of a first end of the bush is supported on a shoulder arranged inside the internal conductor bore of the first or second internal conductor. The internal conductor bore therefore comprises a step and is therefore tapered at least in part. The likewise at least partially peripheral flange of a second end of the bush is supported on the insertion opening of the internal conductor bore, on an outer side of the external conductor housing.

The end of the tuning element that is closer to the insertion opening additionally comprises an attachment device. Said attachment device makes it possible to connect an auxiliary device to the tuning element, it being possible for a tensile and/or compressive movement to be transmitted via said auxiliary device to the tuning means, as a result of which said tuning means can be moved back and forth inside the internal conductor bore. Said auxiliary device is preferably an adjusting device that comprises a coupling means, the coupling means being connected to the attachment device. At least part of the coupling means can be or is inserted into the insertion opening from outside said opening. The mentioned tensile and compressive forces can be transmitted via said connection between the attachment device and the coupling means. In this case, the adjusting device in addition also comprises the linear or stepper motor.

The connection between the attachment device and the coupling means is formed as a detachable connection. In particular a bayonet connection or a screw connection or a latching mechanism or a vacuum connection are possible for this purpose.

In order to be able to ensure frictionless movement of the tuning element inside the internal conductor bore, the attachment device and the tuning element are preferably formed integrally.

After the filter has been tuned, the tuning element is preferably permanently fixed inside the internal conductor bore. This is achieved by means of an adhesive connection, the adhesive connection being introduced into the internal conductor bore from outside the external conductor housing, via the insertion opening, as a result of which the end of the tuning element that is closer to the insertion opening is connected to the inside wall of the internal conductor bore.

BRIEF DESCRIPTION OF THE DRAWINGS

Various embodiments of the invention are described in the following by way of example with reference to the drawings. Like items have like reference numerals. Specifically, in the corresponding figures of the drawings.

DETAILED DESCRIPTION OF NON-LIMITING EMBODIMENTS

Figure 1A:
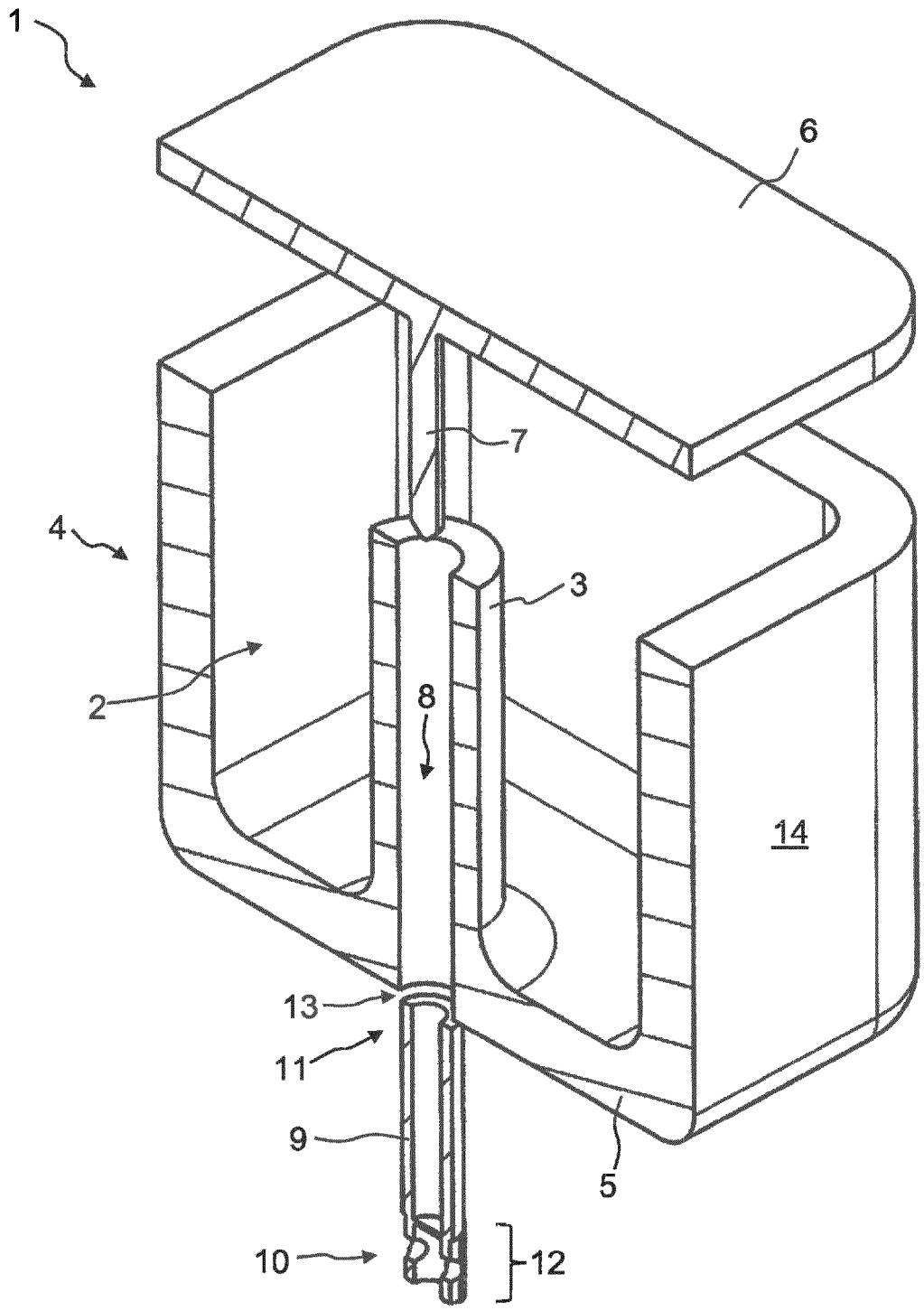
FIGS. 1A and 1B are different three-dimensional views of a longitudinal section through the high frequency filter according to the invention, comprising a threadless tuning element.

FIG. 1A is a three-dimensional view of a longitudinal section through the high frequency filter 1 according to the invention, comprising a threadless tuning element 9. The high frequency filter 1 comprises at least one resonator 2 that comprises a first internal conductor 3 and an external conductor housing 4. The external conductor housing 4 comprises a housing base 5, a housing cover 6 that is spaced apart from the housing base 5, and a peripheral housing wall 14 between the housing base 5 and the housing cover 6. The first internal conductor 3 is galvanically connected to the housing base 5 and extends in the axial direction from the housing base 5 towards the housing cover 6. The first internal conductor 3 ends at a distance from the housing cover 6 and/or is galvanically isolated from the housing cover 6. The first internal conductor 3 and the housing base 5 are preferably formed integrally. A multi-part configuration would also be possible, however.

In addition, the resonator 2 further comprises a second internal conductor 7. The second internal conductor 7 is galvanically connected to the housing cover 6 and extends in the axial direction from the housing cover 6 towards the housing base 5. Both the first and the second internal conductors 3, 7 are axially immovable. The two internal conductors 3, 7 extend towards one another and are oriented coaxially to one another.

The first internal conductor 3 and the housing base 5 are formed integrally. A multi-part configuration would also be possible, however. The same applies for the second internal conductor 7 together with the housing cover 6. The first internal conductor 3 comprises an internal conductor bore 8. The internal conductor bore 8 of the first internal conductor 3 penetrates the external conductor housing 4 and leads into an insertion opening 13. In the embodiment in FIG. 1A, the housing base 5 is penetrated by the internal conductor bore 8.

A tuning element 9 is arranged inside the internal conductor bore 8 of the first internal conductor 3, so as to be axially movable. The tuning element 9 is designed and/or arranged such that a portion of the tuning element 9 enters the free clearance between the two internal conductors 3, 7 to varying extents. The portion of the tuning element 9 that enters the free clearance between the two internal conductors 3, 7 is preferably an end 11 of the tuning element 9 that is remote from the other end 10 arranged closer to the insertion opening 13.

In the embodiment in FIG. 1A, the internal conductor bore 8 is formed only in the first internal conductor 3. As will be explained in the following, it is also possible, however, for said internal conductor bore 8 to be formed on the second internal conductor 7, in which case the housing cover 6 would be penetrated by the internal conductor bore and would comprise the insertion opening 13.

In this case, the tuning element 9 is formed as a hollow cylinder, it preferably being possible for the second internal conductor 7 to be inserted into the hollow cylinder. An attachment device 12 is formed at the further end 10 that is closer to the insertion opening 13 when the tuning element 9 is inserted. As will be explained in more detail in the following, said attachment device 12 makes it possible to move the tuning element 9 axially inside the internal conductor bore 8.

The tuning element 9 is preferably pressed into the internal conductor bore 8 and/or injected therein by means of compressed air. The outside diameter of the tuning element 9 is dimensioned such that force locking is produced between the tuning element 9 and the inside wall of the internal conductor bore 8, i.e. such that the tuning element 9 cannot move autonomously inside the internal conductor bore. The outside peripheral surface of the tuning element 9 and the inside wall of the internal conductor bore 8 should also be taken into account for this purpose. Both surfaces can be considered to be sliding surfaces, it being possible for the lateral peripheral surface of the tuning element 9 to be understood as a first sliding surface and for the inside wall of the internal conductor bore 8 to be understood as a second sliding surface. The coefficient of friction of the two sliding surfaces must be selected such that corresponding force locking is produced.

In FIG. 1A, the inside wall, i.e. the second sliding surface of the internal conductor bore 8, is smooth. This means that the internal conductor bore 8 does not have a thread.

In this case, the tuning element 9 is galvanically isolated from the first and second internal conductor 3, 7.

Figure 1B:
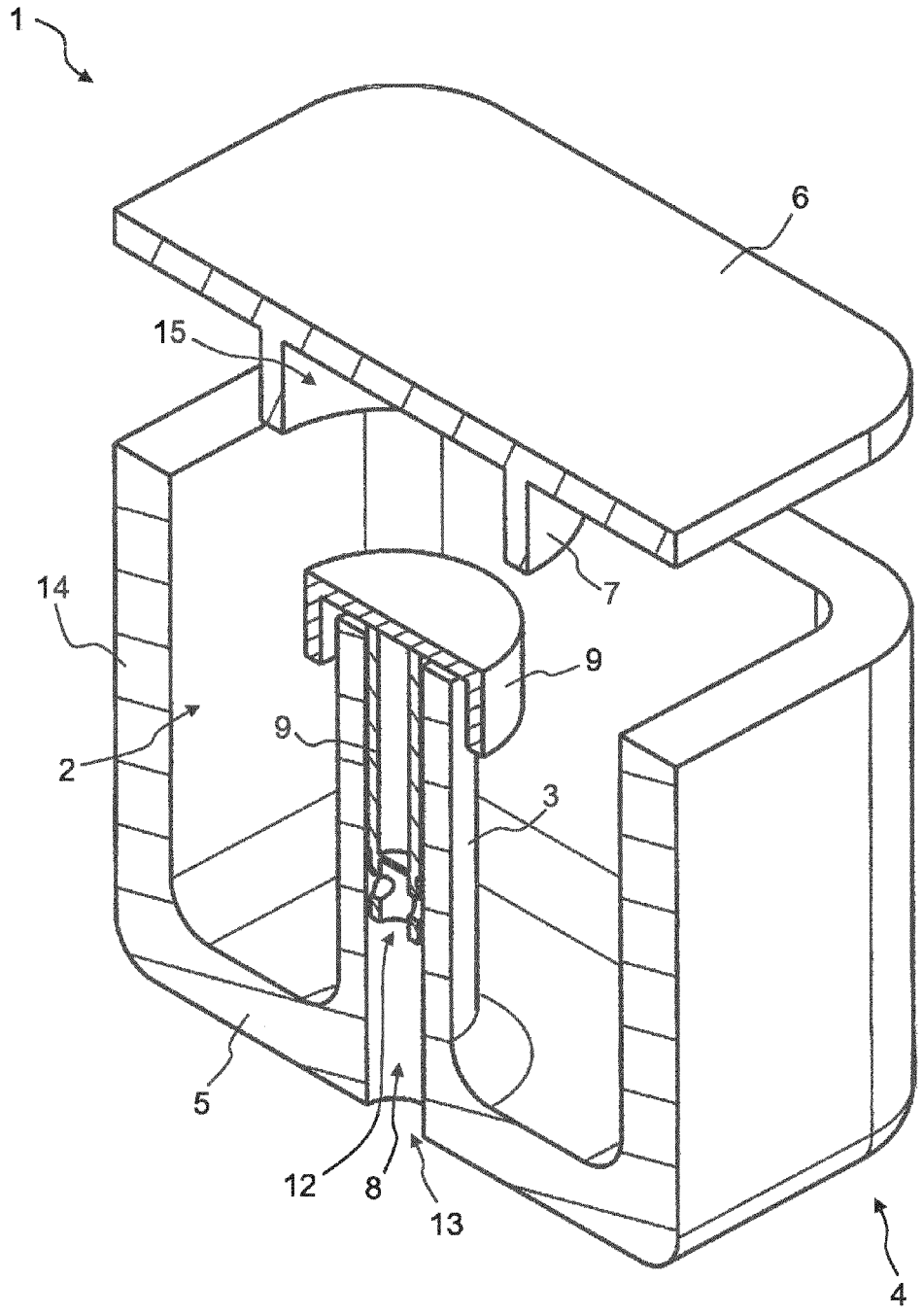

FIG. 1B is a three-dimensional view of a longitudinal section through a further embodiment of the high frequency filter 1 according to the invention. In contrast to the embodiment in FIG. 1A, the second internal conductor 7 also comprises an internal conductor bore 15. The tuning element 9 is inside the internal conductor bore 8 of the first internal conductor 3. The tuning element 9 is designed so as to cover not just part of the inside wall of the internal conductor bore 8, but also the front face of the first internal conductor 3 and the part of the lateral peripheral surface of the first internal conductor 3 that directly adjoins the front face. The tuning element 9 therefore has a mushroom-like shape. In this case, the tuning element 9 is arranged inside the internal conductor bore 8 of the first internal conductor 3 and protrudes therefrom and into the internal conductor bore 15 of the second internal conductor 7, the front faces of the two internal conductors 3, 7 not touching. It is of course also possible for the tuning element 9 to be arranged in the internal conductor bore 15 of the second internal conductor 7.

The tuning element 9 preferably extends over more than 30%, more preferably over more than 40%, more preferably over more than 50%, of the length of the internal conductor bore 8 of the first internal conductor 3. Said tuning element can also extend over more than 100% of the length and project from the internal conductor bore 8 of the first internal conductor 3 at the insertion opening 13. It is also possible, however, for the tuning element 9 not to reach the insertion opening, as shown in FIG. 1B, and to end inside the internal conductor bore 8 of the first internal conductor 3.

In this embodiment, the internal conductor bore 15 of the second internal conductor 7 has a larger diameter than the first internal conductor 3. As a result, the first internal conductor 3 can enter the internal conductor bore 15 of the second internal conductor 7 at least in part, a clearance 16 being formed between the two internal conductors 3, 7, as shown in FIG. 2B.

Figure 2A:
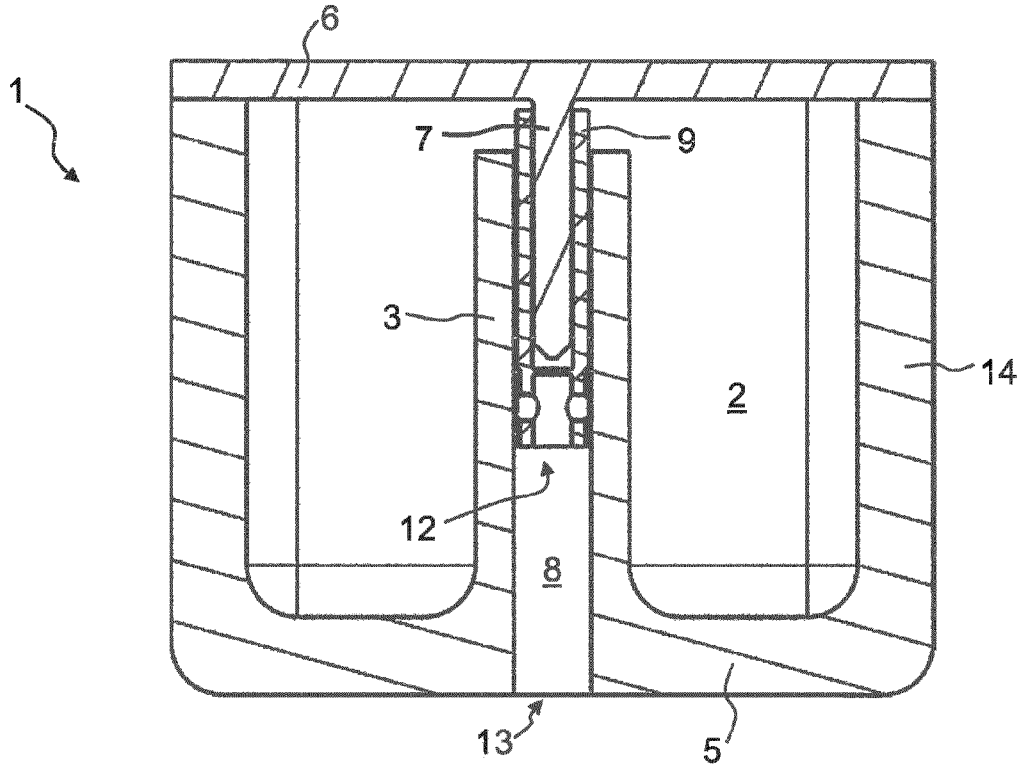
FIGS. 2A and 2B are different two-dimensional longitudinal sections through the embodiments of the high frequency filter according to the invention in FIGS. 1A and 1B.
Figure 2B:
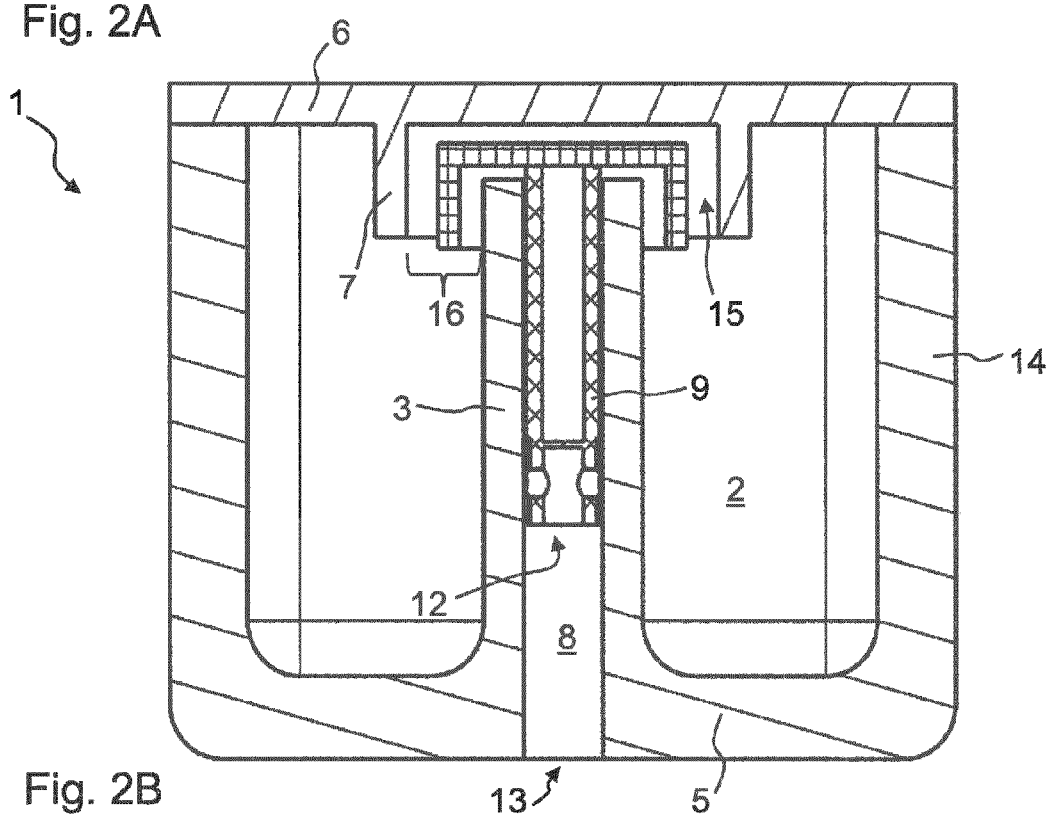

It can also be seen in FIG. 2B that a two-part design of the tuning element 9 is possible.

A first part is located inside the internal conductor bore 8 of the first internal conductor 3, while a second part is located outside the internal conductor bore 8 and for example covers the front face of the first internal conductor 3 and the part of the lateral peripheral surface that adjoins the front face.

The tuning element 9 can, of course, also be formed integrally. FIG. 2B is a two-dimensional longitudinal section from the embodiment of the high frequency filter 1 shown in FIG. 1B.

In contrast, FIG. 2A is a two-dimensional longitudinal section from the embodiment of the high frequency filter 1 as shown in FIG. 1A. In FIG. 2A, the tuning element 9 extends almost to the housing cover 6.

In principle, the tuning element 9 prevents the first internal conductor 3 and the second internal conductor 7 from directly overlapping.

This means that neither the front faces of the first or second internal conductor 3, 7 face one another without being separated by the tuning element 9, nor do two lateral peripheral surfaces of the first or second internal conductor 3, 7 directly face one another without being separated by the tuning element 9.

Figure 3A:
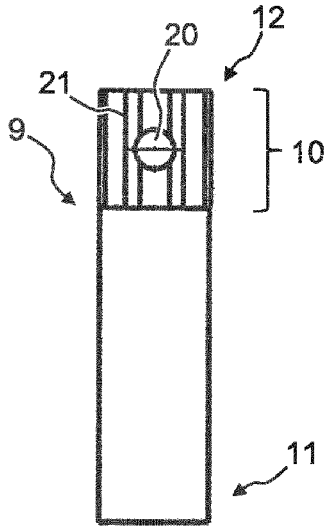
FIG. 3A is a side view of an embodiment of a tuning element, one end of the tuning element being oversized and another end being undersized with respect to an internal conductor bore.
Figure 3B:
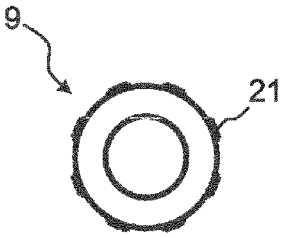
FIG. 3B is a cross section through the oversized end of the tuning element in FIG. 3A.

FIG. 3A is a side view of an embodiment of a tuning element 9, one end 10 of the tuning element 9 being oversized and the remainder of the tuning element 11, and thus inter alia another end 11, being undersized with respect to an internal conductor bore 8. FIG. 3B is a corresponding cross section through the end 10 of the oversized tuning element 9. The oversize results from a diameter that is increased at least in portions, in the form of elevations 21 extending in the longitudinal direction, i.e. in the axial direction of the tuning element 9. Said elevations 21 preferably extend over a length of less than a third, more preferably of less than a quarter, of the overall length of the tuning element 9.

Said elevations 21 can for example be added during a milling or casting process in which the tuning element 9 is fundamentally produced.

Furthermore, an attachment opening 20 is also shown, which opening receives a latching means 45, as will be described in the further drawings. The end 10 that comprises the attachment opening 20 is also considered to be an attachment device 12.

The elevations 21 of the tuning element 9 in FIG. 3A are preferably resilient.

The tuning element 9 preferably consists of a dielectric material, in particular a ceramic or a plastics material.

Figure 4A:
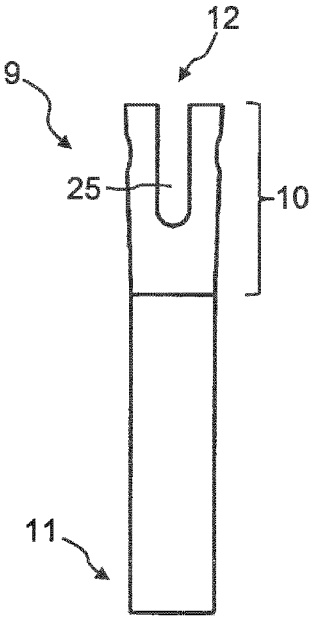
FIG. 4A is a side view of a further embodiment of the tuning element, one end of the tuning element being slotted and widened towards the outside, and thus being resilient at the end thereof.
Figure 4B:
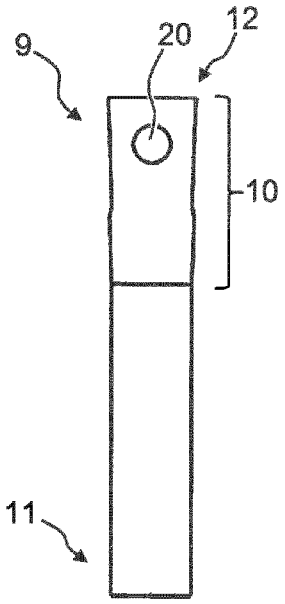
FIG. 4B is a side view of the tuning element in FIG. 4A rotated by a specific angle of rotation, an engagement opening for a coupling means being visible.

FIGS. 4A and 4B are side views of a further embodiment of the tuning element 9, the end 10 of the tuning element 9 comprising a slot 25 in the longitudinal direction and widening towards the outside. As a result of said slot 25, the end 10 of the tuning element 9 that, in the inserted state, is preferably closer than the other end 11 to the insertion opening 13 has resilient properties and can bend, in the radial direction, towards the longitudinal axis, the longitudinal axis extending centrally through the tuning element 9.

In FIGS. 3A and 4A, the region having the increased diameter is arranged at the end 10 of the tuning element 9. It would also be conceivable, however, for the region having the widened diameter to be located in the centre of the tuning element 9.

FIG. 4B is another side view of the tuning element 9, as shown in FIG. 4A, although in FIG. 4B the tuning element 9 has been rotated by approximately 90°. The attachment opening 20 can also be seen in this view, which opening is in turn part of the attachment device 12 of the tuning element 9 and by means of which, as will be explained further below, the tuning element 9 can be moved axially inside the internal conductor bore 8.

Figure 5A:
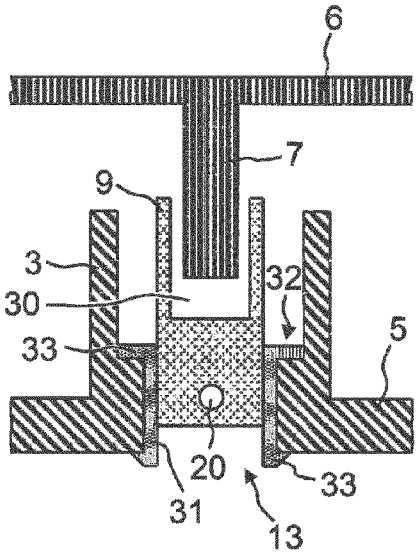
FIG. 5A is a longitudinal section through a further embodiment of the high frequency filter according to the invention, a bush being inserted into the internal conductor bore, between which bush and the tuning element a frictional connection exists.

FIG. 5A is a longitudinal section through a further embodiment of the high frequency filter 1 according to the invention, a bush 31 being inserted into the internal conductor bore 8 of the first internal conductor 3, into which bush the tuning element 9 is inserted, a frictional connection existing between the bush 31 and the tuning element 9.

The bush 31 preferably consists of a resilient material. In this case, the bush 31 is preferably formed integrally, although a multi-part configuration would also be possible.

In the event of the bush 31 being formed of a dielectric material, the tuning element 9 can also be formed of an electrically conductive material. However, the tuning element 9 preferably also consists of a dielectric material.

Figure 5B:
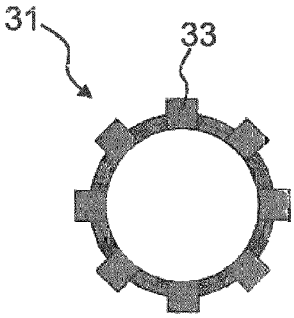
FIG. 5B is a cross section through the bush in FIG. 5A.

The bush 31 is arranged in a form-locked or force-locked manner inside the internal conductor bore 8 of the first or second internal conductor 3, 7. As shown in the cross section in FIG. 5B, both ends of the bush 31 comprise an at least partially peripheral flange 33. On account of said partially peripheral flange 33, the bush 31 is arranged in an axially immovable manner inside the internal conductor bore 8 of the first internal conductor 3. The at least partially peripheral flange 33 of the first end of the bush 31 is supported inside the first internal conductor 3 on a shoulder 32 of the internal conductor bore 8 of said first internal conductor. The at least partially peripheral flange 33 of the second end of the bush 31 is supported, on the outer side of the external conductor housing 4, on the insertion opening 13 of the internal conductor bore 8 of the first internal conductor 3. The bush 31 is preferably pressed in.

Instead of a bush 31 that is inserted into the internal conductor bore 8 before the tuning element 9 is inserted, it would also be possible to fit a sleeve on the tuning element 9, the tuning element 9 being introduced into the internal conductor bore 8 together with the sleeve.

In FIG. 5A, the two internal conductors 3, 7 overlap in part, the overlap region being formed in the tuning element 9.

FIG. 5A also shows that the tuning element 9 on the end 10 furthest from the insertion opening 13 a receiving opening 30 is formed. The second internal conductor 7 enters the receiving opening 30 of the tuning element 9.

It would of course also be possible for the tuning element 9 to be inserted into the internal conductor bore 15 of the second internal conductor 7, in which case the first internal conductor 3 would enter the receiving opening 30.

Figure 6:
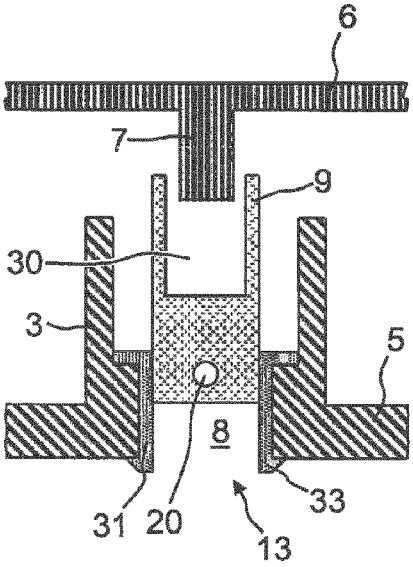
FIG. 6 is a longitudinal section through a further embodiment of the high frequency filter according to the invention, the two internal conductors being arranged so as not to have any mutual overlap.

FIG. 6 shows an embodiment of the invention high frequency filter 1 according to the invention which is very similar to the embodiment of the high frequency filter 1 according to the invention shown in FIG. 5A. The only difference is that the two internal conductors 3, 7 do not overlap.

Figure 7:
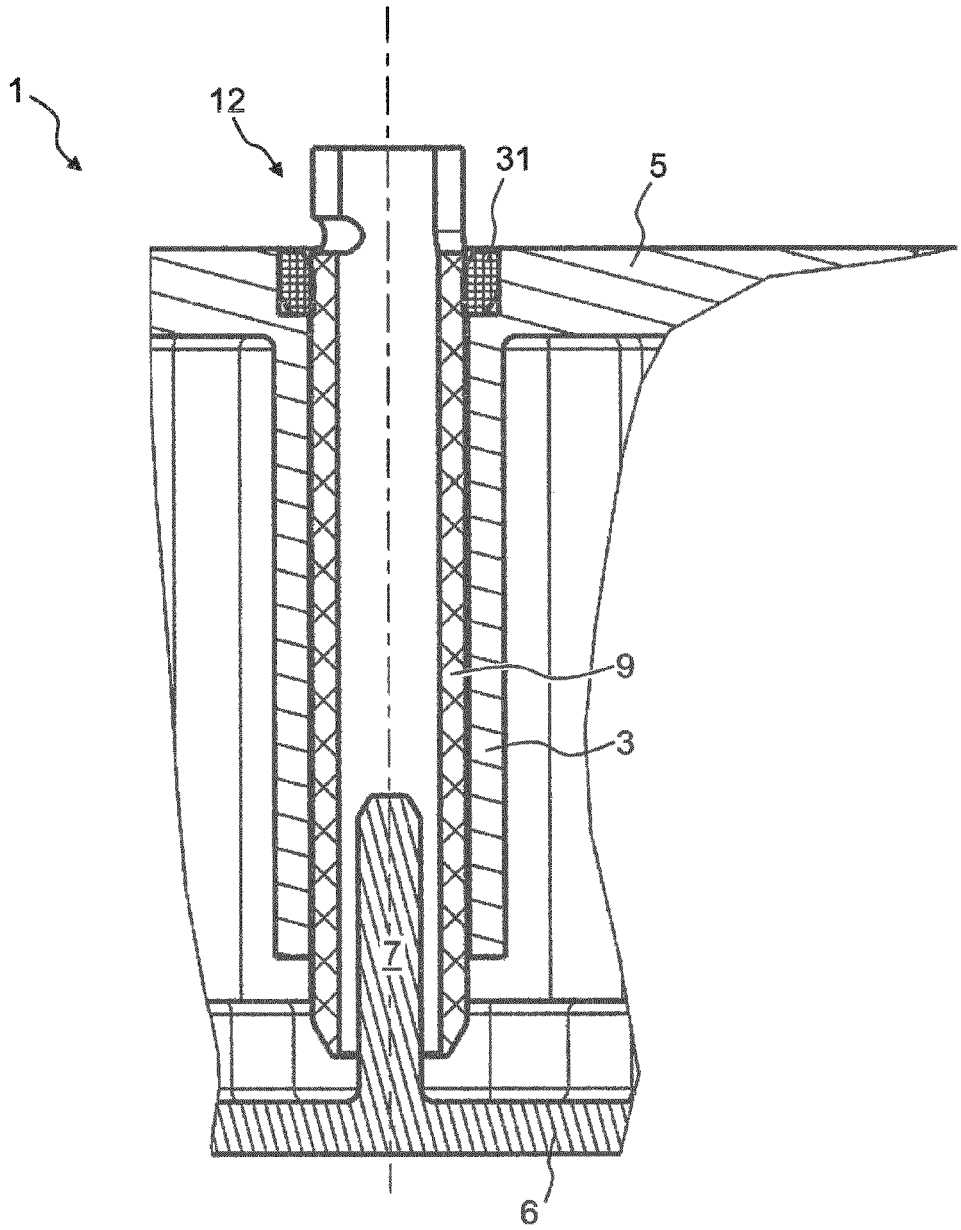
FIG. 7 is a longitudinal section through a further embodiment of the high frequency filter according to the invention, the bush being formed as a resilient ring on the insertion opening.

FIG. 7 is a longitudinal section through a further embodiment of the high frequency filter 1 according to the invention, the bush 31 being formed as a resilient ring on the insertion opening 13. In this case, the tuning element 9 is again inside the internal conductor bore 8 of the first internal conductor 3. The only difference is that the view has been rotated by 180 degrees. The tuning element 9 could, however, also be formed in the internal conductor bore 15 of the second internal conductor 7. The bush 31, which is in the shape of a resilient ring, protrudes at least in part into the internal conductor bore 8 of the first internal conductor 3. When inserting the tuning element 9 into the internal conductor bore 8, the ring is therefore widened and, on account of the resilience thereof, ensures a force-locked connection to the tuning element 9. The bush 31 is preferably rigidly connected, by means of an adhesive connection, to the insertion opening 13 which is wider than the internal conductor bore 8. In this case, the bush 31 is rigidly connected to the housing base 5 but could equally be rigidly connected to the housing cover 6.

Figure 8:
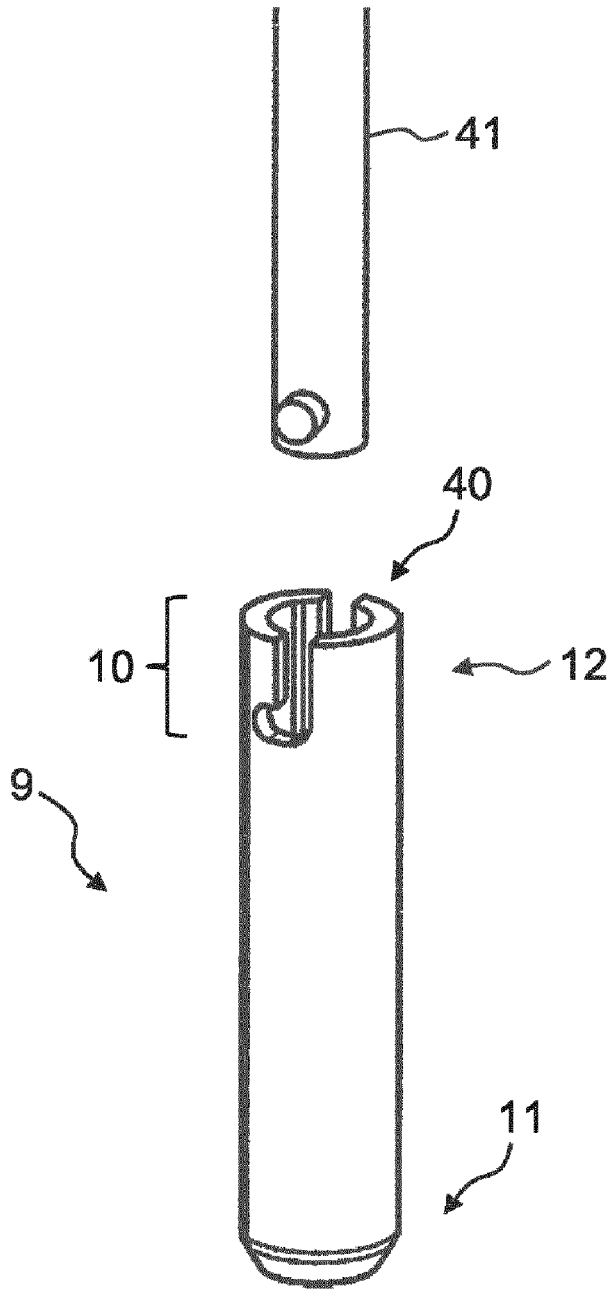
FIG. 8 is a three-dimensional view of a connection formed by the attachment device and the coupling means, in the form of a bayonet connector.

FIG. 8 is a three-dimensional view of a connection formed by the attachment device 12 and the coupling means 41, in the form of a bayonet connector. The tuning element 9 comprises the attachment device 12 at the end 10 of said tuning element that is closer to the insertion opening 13 in the inserted state. The attachment device 12 consists of an elongate slot and a transverse slot that are interconnected. Said elongate slot and said transverse slot preferably emerge at two locations on the lateral peripheral surface of the tuning element 9. The coupling means 41 preferably comprises, at two locations, a region having a widened diameter, in particular a pin oriented radially outwards. Said radially outward-oriented pin corresponds to the cylindrical coupling means 41 in such a way that the coupling means 41 can be inserted into the tuning element 9 that is formed as a hollow cylinder, the pin of the coupling means 41 being guided in a stop-limited manner inside the elongate slot and thus allowing the coupling means 41 to be pushed into the tuning element 9. As soon as the pin of the coupling means 41 reaches the stop-limitation at the end of the elongate slot, rotation of the coupling means 41 in a clockwise or anti-clockwise direction closes the bayonet connector. Subsequently, the pin of the coupling means 41 slides into the transverse slot of the tuning element 9. In this case, the pin is mounted in a stop-limited manner, so that both tensile and compressive forces can be instantaneously transmitted from the coupling means 41 to the tuning element 9. In this case, the coupling means 41 is connected to a stepper motor or to a linear motor. The bayonet connector is a detachable connection. At least part of the coupling means 41 is located outside the insertion opening 13, but can be inserted into said opening and into the internal conductor bore 8.

The elongate slot and the transverse slot could of course also be formed in the coupling means 41, in which case the pin would, conversely, have to be formed in the tuning element 9.

Figure 9A:
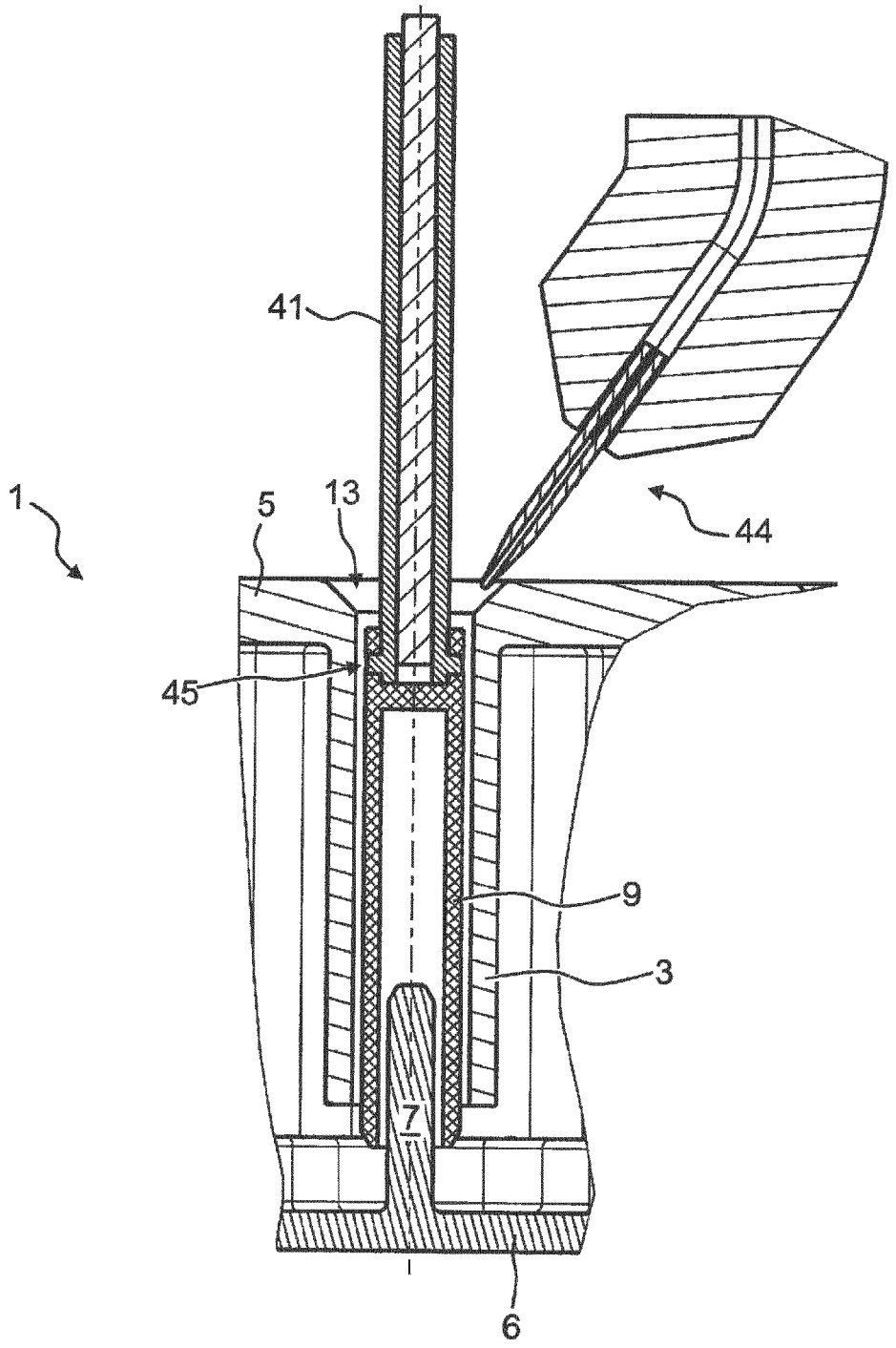
FIGS. 9A, 9B and 9C are different longitudinal sections through an embodiment of the high frequency filter according to the invention, the connection between the attachment device and the coupling means being a latching mechanism, and the tuning element being fixed inside the internal conductor bore by means of an adhesive.
Figure 9B:
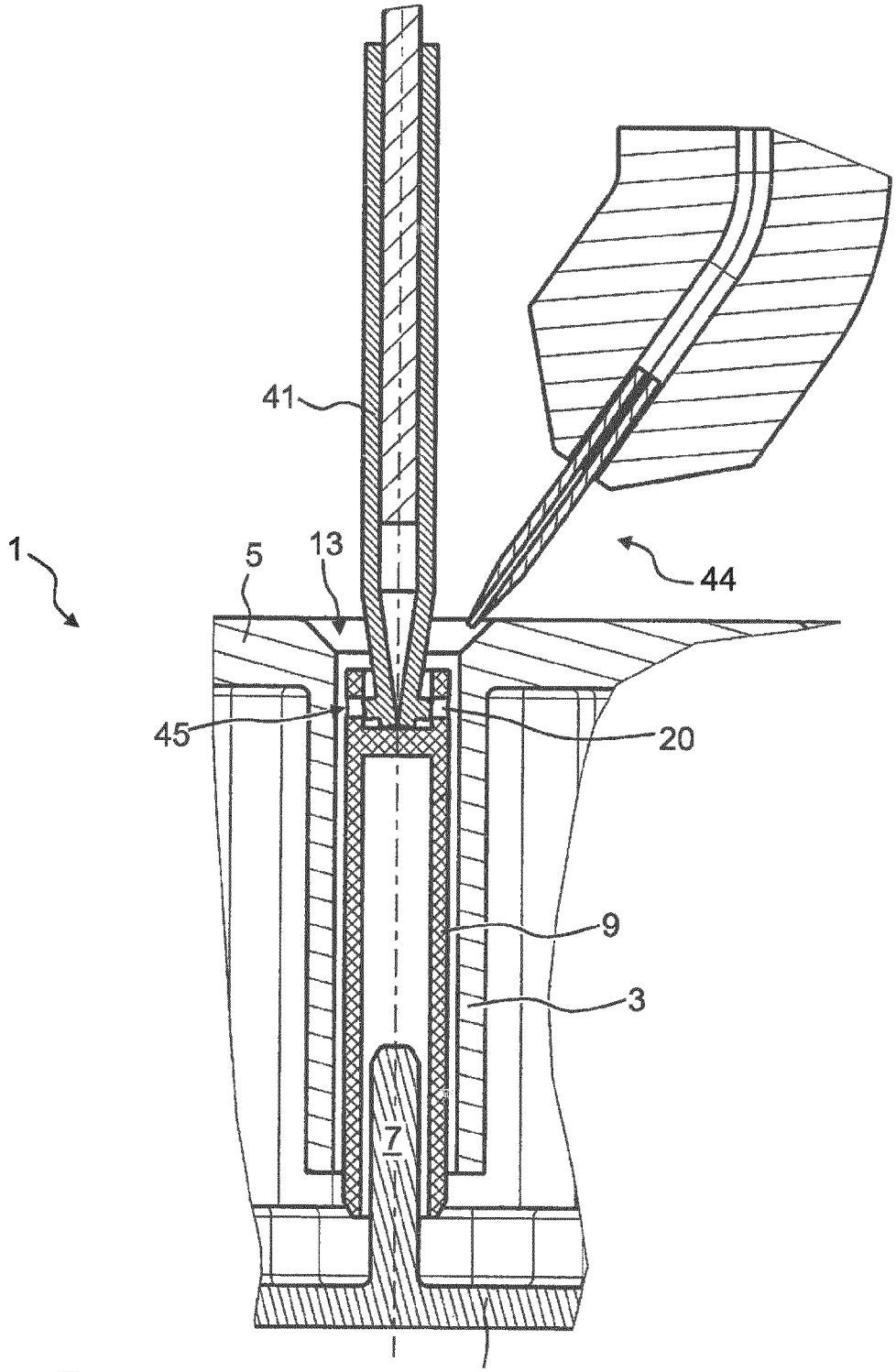
Figure 9C:
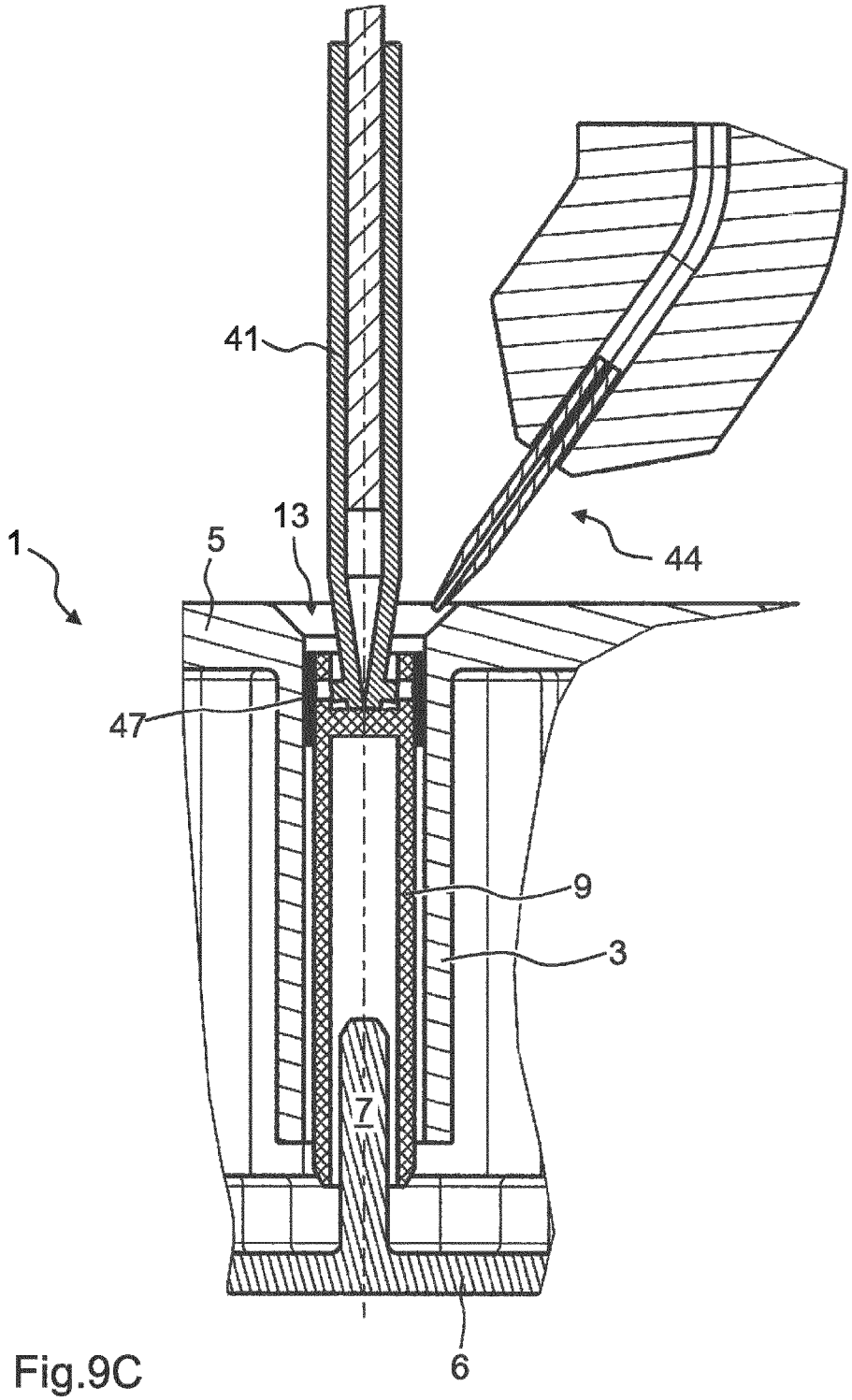

FIGS. 9A, 9B and 9C are different longitudinal sections through an embodiment of the high frequency filter 1 according to the invention, the connection between the attachment device 12 and the coupling means 41 being a latching mechanism 45, and the tuning element 9 being fixed inside the internal conductor bore 8 by means of an adhesive 47. FIG. 9A shows that an end of the coupling means 41 that comes into contact with the tuning element 9 is resilient and can be bent radially inwards, i.e. towards the longitudinal axis that passes through the coupling means 41. In the embodiment in FIG. 9A, the end of the coupling means 41 is not bent towards the longitudinal axis, but is instead in an unstressed state. At least one pin is located on the outer periphery of the end of the coupling means 41. There are two pins in the embodiment in FIG. 9A. These two pins engage in the attachment openings 20, as shown for example in FIGS. 3A and 4B. In this latching mechanism 45, the coupling means 41 can be inserted into the tuning element 9, which is formed as a hollow cylinder at least in part, and can be rigidly connected, by means of a click connection, in such a way that tensile or compressive forces can be transmitted instantaneously.

A gap between the outer peripheral surface of the tuning element 9 and the inside wall of the internal conductor bore 8 is shown excessively thick. As before, a force-fitting connection exists between the tuning element 9 and the internal conductor bore 8. The tuning element 9 could of course also be inserted into the internal conductor bore 15 of the second internal conductor 7 and not, as here, be inserted into the internal conductor bore 8 of the first internal conductor 3.

Furthermore, a gluing device 44 is shown, via which an adhesive 47 can be introduced into the insertion opening 13. The gluing device 44 is preferably also part of the adjusting device.

In FIG. 9B, the tuning element 9 has been placed in the desired position inside the internal conductor bore 8 of the first internal conductor 3 using the coupling means 41. The end of the coupling means 41 that is in contact with the tuning element 9 is tapered, i.e. has contracted towards the longitudinal axis. The pins that are attached to the lateral peripheral surface of the end of the coupling means 41 are now no longer engaged with the attachment openings 20 of the attachment device 12 of the tuning element 9. The coupling means 41 can be removed from the insertion opening 13 of the high frequency filter 1 by means of axial movement.

FIG. 9C shows the coupling means 41, the ends of said means having contracted towards the longitudinal axis. The end of the coupling means 41 is preferably in the shape of tweezers, the widenings, i.e. the pins, which engage in the attachment openings 20, being attached to the lateral peripheral surface. The tips of the coupling means 41 can contract until they touch one another. In FIG. 9C, the adhesive 47 has also already been introduced, in order to connect the tuning element 9 to the internal conductor bore 8 of the first internal conductor 3.

The end 10 of the tuning element 9 that is closer to the insertion opening 13 preferably has a smaller diameter than the other end 11 or the middle of the tuning element 9. This results in a cavity between the tuning element 9 and the inside wall of the internal conductor bore 8 of the first internal conductor 3, into which cavity the adhesive 47 can be introduced.

Figure 10:
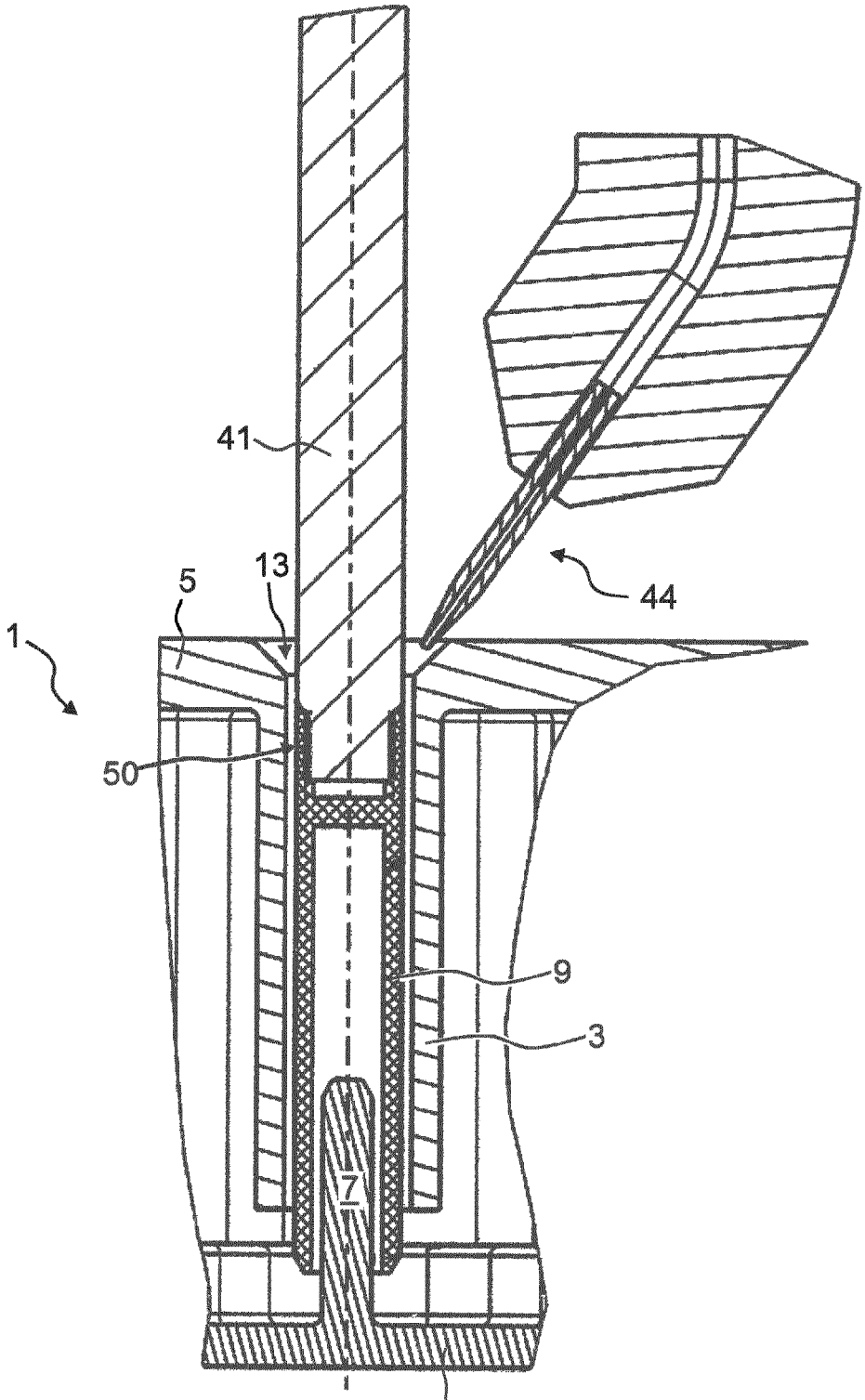
FIG. 10 is a longitudinal section through an embodiment of the high frequency filter according to the invention, the connection between the attachment device and the coupling means being a screw connection.

FIG. 10 shows a further embodiment of the high frequency filter 1 according to the invention, the connection between the attachment device 12 on the tuning element 9 and the coupling means 41 being a screw connection 50. For this purpose, the tuning element 9 comprises an internal thread on the end 10 that is closer to the insertion opening 13, in which internal thread the end of the coupling means 41, which comprises an external thread, can engage. It would also be possible for the tuning element 9 to comprise an external thread and to be correspondingly connected to the coupling means 41.

Figure 11:
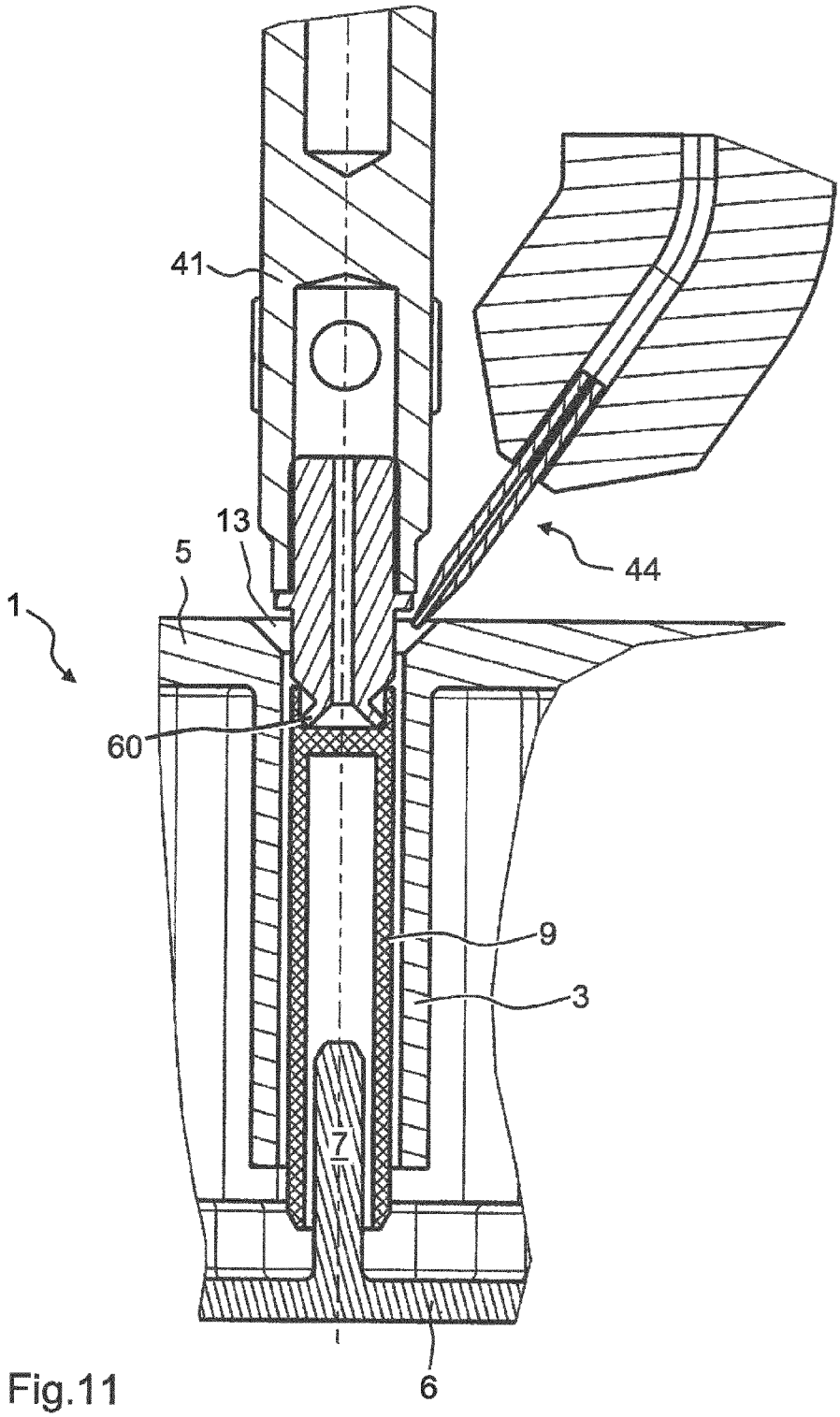
FIG. 11 is a longitudinal section through a further embodiment of the high frequency filter according to the invention, the connection between the attachment device and the coupling means being a vacuum connection.

FIG. 11 shows a further embodiment of the high frequency filter 1 according to the invention, the connection between the tuning element 9, on the attachment device 12 thereof, and the coupling means 41 being produced by a vacuum. For this purpose, the end of the coupling means 41 that is in contact with the tuning element 13 comprises vacuum nozzles 60 that are capable of suctioning air. Said vacuum nozzles 60 are in contact with a corresponding engagement surface on the attachment device 12 of the tuning element 9. In this case, there should be a clearance fit between the tuning element 9 and the internal conductor bore 8 of the first internal conductor 3. The gap between the tuning element 9 and the internal conductor bore 8 of the first internal conductor 3 is subsequently filled with the adhesive 47. In this case, an adhesive 47 having a suitable viscosity should be used. The tuning element 9 is retained on the vacuum nozzles 60 by means of the vacuum, with the result that the tuning element 9 can be pulled closer to the insertion opening 13, for the purpose of tuning, by means of a movement of the vacuum nozzles 60. In order to move the tuning element 9 away from the insertion opening 13 again, the vacuum nozzles 60 press mechanically on the attachment device 12 and thus push the tuning element 9 further into the resonator 2. It is also possible for a part of the tuning element 9, in particular the end 10 that comes into contact with the coupling means 41, to project from the external conductor housing 4.

Figure 12:
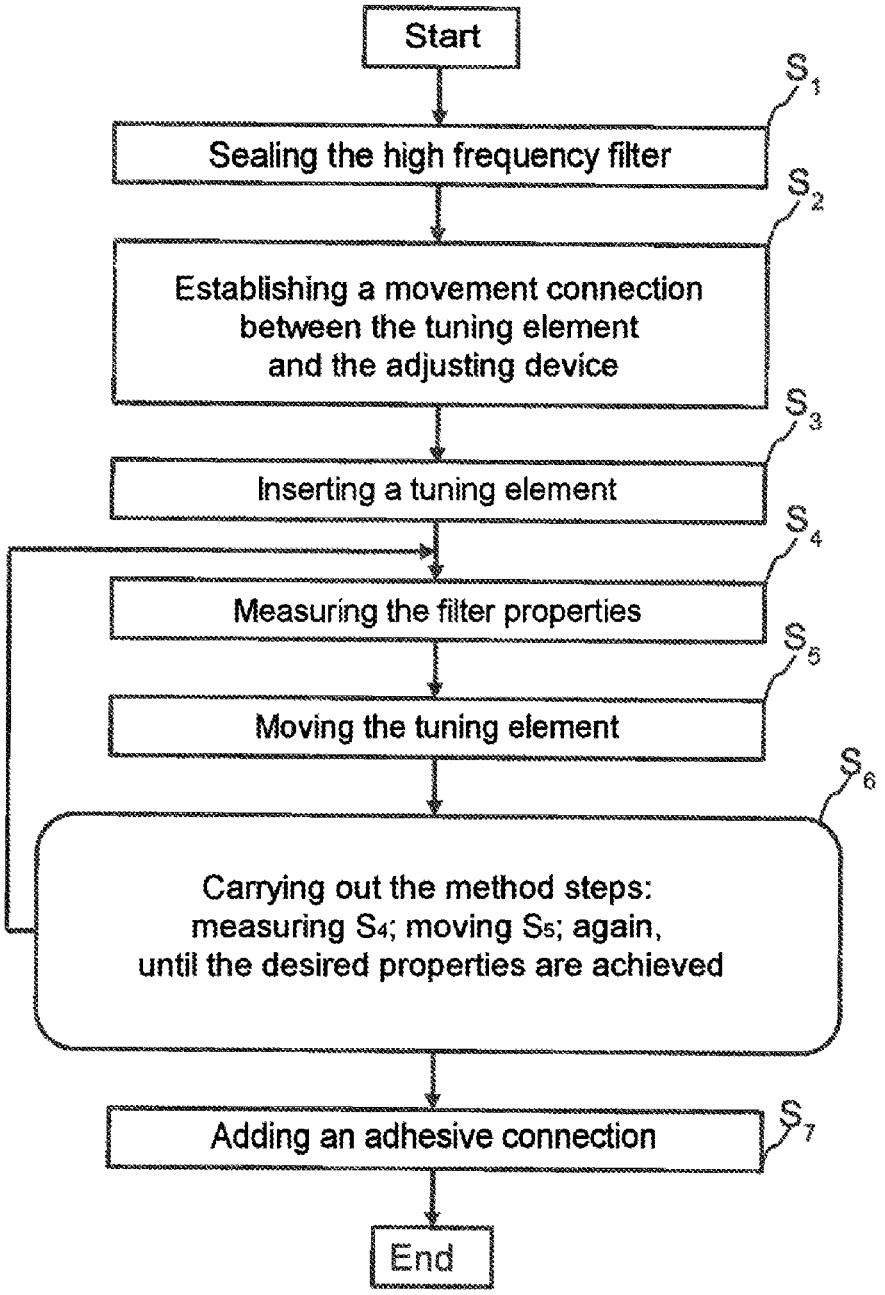
FIG. 12 is a flow diagram explaining how the high frequency filter according to the invention is tuned.

The attachment device 12 and the tuning element 9 are preferably formed integrally. FIG. 12 shows a method for tuning the high frequency filter 1 according to the invention. The high frequency filter is sealed in method step $S_1$. This means that the corresponding input terminals and the housing cover 6 are fitted. In the process, the high frequency filter 1 is sealed in a high-frequency-proof manner. The screw connections are also tightened for this purpose.

In a further method step $S_2$, the connection between the attachment device 12 of the tuning element 9 and the coupling means 41 of the adjusting device is produced. This connection can, as already stated, be a bayonet connection 40 or a screw connection 50 or a latching mechanism 45 or a vacuum connection.

Subsequently, in method step $S_3$, the tuning element 9 is inserted into the internal conductor bore 8, 15 of the first or second internal conductor 3, 7. This insertion can be achieved by pressing in or by injection by means of compressed air.

Steps $S_1$, $S_2$, $S_3$ can be carried out in any desired sequence.

Subsequently, method step $S_4$ is carried out. In method step $S_4$, the filter properties are measured. This includes, for example, measuring the resonance frequency.

Subsequently, method step $S_5$ is carried out, in which step the tuning element 9 is pushed towards the insertion opening 13 or away from the insertion opening 13, by means of the adjusting device. Step sizes in the order of magnitude of a few micrometres can be selected using a linear motor or stepper motor.

As soon as the tuning element 9 has been moved by a specified travel range, method step $S_6$ is carried out. In method step $S_6$, method steps $S_4$ and $S_5$ are repeated until the desired filter properties are achieved.

As soon as this is the case, method step $S_7$ is carried out, in which step the tuning element 9 is fixed in the internal conductor bore 8, 15 of the first or second internal conductor 3, 7 by means of an adhesive connection.

Before or after method step $S_7$, the connection between the coupling means 41 and the attachment device 12 can be released again, and the coupling means 41 can be removed from the insertion opening 13.

The invention is not limited to the embodiments described. Within the scope of the invention, all the features described and/or illustrated can be combined with one another as desired.

The invention claimed is:

1. A high frequency filter in coaxial construction, comprising:

at least one resonator comprising a first internal conductor and an external conductor housing;

the external conductor housing comprising a housing base, a housing cover that is spaced apart from the housing base, and a peripheral housing wall between the housing base and the housing cover;

the first internal conductor being galvanically connected to the housing base and extending in an axial direction from the housing base towards the housing cover, the first internal conductor ending at a distance from the housing cover and/or being galvanically isolated from the housing cover;

wherein:

the at least one resonator comprises a second internal conductor;

the second internal conductor is galvanically connected to the housing cover and extends in the axial direction from the housing cover towards the housing base;

the first and the second internal conductors are axially immovable;

the first and the second internal conductors are mutually coaxial;

the first and/or second internal conductors comprise an internal conductor bore;

the internal conductor bore of the first or second internal conductor penetrates the external conductor housing and leads into an insertion opening;

a tuning element is arranged inside the internal conductor bore of the first or second internal conductor so as to be axially movable;

the tuning element is designed and/or arranged such that a portion of the tuning element enters a free clearance between the two internal conductors to varying extents, a bush or a sleeve is arranged in a form-locked or force-locked manner inside the internal conductor bore, between the first internal conductor and the tuning element or the second internal conductor and the tuning element; and/or the tuning element comprises a region having a widened diameter, this region being located either:

a) in the center of the tuning element; and/or b) at the end of the tuning element that is closer to the insertion opening, the region having the widened diameter being elastically deformable, in the radial direction, towards a longitudinal axis that extends centrally through the tuning element;

the tuning element further comprises an attachment device at the end of said tuning element that is closer to the insertion opening;

the high frequency filter further comprises an adjusting device that comprises a coupler connected to the attachment device, at least part of the coupler being able to be inserted or being inserted into the insertion opening from outside said insertion opening;

wherein both tensile and compressive forces can be transmitted via the connection between the attachment device and the coupler, as a result of which the tuning element can be or is moved towards the insertion opening or away from the insertion opening, inside the internal conductor bore of the first or second internal conductor.

2. The high frequency filter according to claim 1, wherein:

the first internal conductor and the housing base are formed integrally and/or the second internal conductor and the housing cover are formed integrally.

3. The high frequency filter according to claim 1, wherein:

the tuning element or a sleeve or surface coating located thereon comprises a first sliding surface, and the internal conductor bore or a bush inserted therein or a surface coating, located thereon, of the first or second internal conductor comprises a second sliding surface, and a) the first sliding surface of the tuning element is axially movable along the second sliding surface, inside the internal conductor bore of the first or second internal conductor and/or b) there is a threadless force-locked or frictional connection between the first sliding surface of the tuning element and the second sliding surface of the internal conductor bore of the first or second internal conductor.

4. The high frequency filter according to claim 1, wherein:

an inside wall of the first and second internal conductors bore is smooth.

5. The high frequency filter according to claim 1, wherein:

the tuning element is electrically conductive; and the tuning element is galvanically isolated from the first and second internal conductors.

6. The high frequency filter according to claim 1, wherein:

both ends of the bush comprise an at least partially peripheral flange, such that the bush is arranged in an axially immovable manner inside the internal conductor bore of the first or second internal conductor;

the at least partially peripheral flange of a first end of the bush is supported inside the first or second internal conductor on a shoulder of the internal conductor bore of said first or second internal conductor;

the at least partially peripheral flange of a second end of the bush is supported, on the outer side of the external conductor housing, on the insertion opening of the internal conductor bore of the first or second internal conductor.

7. The high frequency filter according to claim 1, wherein:

the bush is formed integrally or in multiple parts and/or consists of a resilient dielectric material, and the tuning element:

a) is formed integrally or in multiple parts; and/or b) consists of a dielectric material or an electrically conductive material;

or the tuning element:

a) is formed integrally or in multiple parts; and/or b) consists of a dielectric material, comprising a ceramic or a plastics material.

8. The high frequency filter according to claim 1, wherein:

the tuning element is arranged inside the internal conductor bore of the first internal conductor and protrudes therefrom and into the internal conductor bore of the second internal conductor, front faces of the two internal conductors not touching; or the tuning element is arranged inside the internal conductor bore of the second internal conductor and protrudes therefrom and into the internal conductor bore of the first internal conductor, the front faces of the two internal conductors not touching.

9. The high frequency filter according to claim 8, wherein:

the first and second internal conductors are arranged so as not to have any mutual overlap, such that neither of the two internal conductors enters the other internal conductor.

10. The high frequency filter according to claim 1, wherein:

a) the internal conductor bore of the first internal conductor has a larger diameter than the second internal conductor;

the second internal conductor enters the internal conductor bore of the first internal conductor at least in part, a clearance being formed between the two internal conductors;

the tuning element is designed and/or arranged such that a portion of the tuning element enters a clearance between the two internal conductors to varying extents; or b) the internal conductor bore of the second internal conductor has a larger diameter than the first internal conductor;

the first internal conductor enters the internal conductor bore of the second internal conductor at least in part, a clearance being formed between the two internal conductors; the tuning element is designed and/or arranged such that a portion of the tuning element enters a clearance between the two internal conductors to varying extents.

11. The high frequency filter according to claim 1, wherein:

the tuning element comprises a receiving opening on the end furthest from the insertion opening;

the tuning element is arranged inside the internal conductor bore of the first internal conductor, the second internal conductor entering the receiving opening of the tuning element; or the tuning element is arranged inside the internal conductor bore of the second internal conductor, the first internal conductor entering the receiving opening of the tuning element.

12. The high frequency filter according to claim 1, wherein:

the tuning element is fixed inside the internal conductor bore of the first or second internal conductor by an adhesive connection, the adhesive connection being attached at the end of the tuning element that is closer to the insertion opening.

13. The high frequency filter according to claim 1, wherein:

the connection between the attachment device and the coupler is formed as a detachable connection, in particular as:

a) a bayonet connection; or b) a screw connection; or c) a latching mechanism; or d) a vacuum connection.

14. The high frequency filter according to claim 1, wherein:

the attachment device and the tuning element are formed integrally.

15. The high frequency filter according to claim 1, wherein:

the internal conductor bore of the first or second internal conductor widens towards the insertion opening.

16. A high frequency filter comprising:

at least one resonator comprising first and second internal conductors and an external conductor housing;

the first and the second internal conductors being axially immovable and mutually coaxial;

the external conductor housing comprising a housing base, a housing cover that is spaced apart from the housing base, and a peripheral housing wall disposed between the housing base and the housing cover;

the first internal conductor being galvanically connected to the housing base and extending in an axial direction from the housing base towards the housing cover, the first internal conductor having a distal end disposed at a distance from the housing cover and/or the first internal conductor otherwise being galvanically isolated from the housing cover;

the second internal conductor being galvanically connected to the housing cover and extending in the axial direction from the housing cover towards the housing base;

the first and/or second internal conductors comprising a respective internal conductor bore penetrating the external conductor housing and leading into an insertion opening, wherein an inside wall of the respective internal conductor bore is smooth;

a tuning element disposed inside the internal conductor bore so as to be axially movable during a tuning process, the tuning element being structured such that a portion of the tuning element enters a free clearance between the first and second internal conductors to varying extents; and at least one of the following:

(x) a bush or a sleeve arranged in a form-locked or force-locked manner inside the internal conductor bore between the first internal conductor and the tuning element or the second internal conductor and the tuning element; and (y) the tuning element comprising a region having a widened diameter, the region being located at least one of a) in the center of the tuning element; and b) at an end of the tuning element that is closer to the insertion opening, the region being elastically deformable, in the radial direction, towards a longitudinal axis that extends centrally through the tuning element.

17. Method for tuning a high frequency filter, comprising:

sealing the high frequency filter;

producing a connection between an attachment device of a tuning element and a coupler of an adjusting device, the coupler being connected to the attachment device, at least part of the coupler being able to be inserted or being inserted into an insertion opening from outside said insertion opening, the tuning element comprising the attachment device at the end of said tuning element that is closer to the insertion opening;

inserting, comprising pressing, the tuning element into an internal conductor bore of a first or a second internal conductor;

wherein sealing, producing and inserting can be carried out in any desired sequence;

measuring filter properties of the high frequency filter;

tuning the high frequency filter by axially moving the tuning element inside the internal conductor bore of the first or second internal conductor towards the insertion opening or away from the insertion opening, using the coupler of the adjusting device, wherein both tensile and compressive forces are transmitted via the connection between the attachment device and the coupler, as a result of which the tuning element is moved towards the insertion opening or away from the insertion opening, inside the internal conductor bore of the first or second internal conductor;

repeating the measuring and moving until the high frequency filter has the desired filter properties; and adding an adhesive connection between the tuning element and the internal conductor bore of the first or second internal conductor.

* * * * *